US007719475B2

(12) United States Patent
Kuehne

(10) Patent No.: US 7,719,475 B2
(45) Date of Patent: May 18, 2010

(54) WINDOW-INTEGRATED ANTENNA IN VEHICLES

(75) Inventor: Rainer Kuehne, Hannover (DE)

(73) Assignee: Robert Bosch GmbH, Stuttgart (DE)

( * ) Notice: Subject to any disclaimer, the term of this patent is extended or adjusted under 35 U.S.C. 154(b) by 499 days.

(21) Appl. No.: 10/583,237

(22) PCT Filed: Nov. 5, 2004

(86) PCT No.: PCT/EP2004/052836

§ 371 (c)(1),
(2), (4) Date: May 8, 2007

(87) PCT Pub. No.: WO2005/060044

PCT Pub. Date: Jun. 30, 2005

(65) Prior Publication Data

US 2008/0055169 A1 Mar. 6, 2008

(30) Foreign Application Priority Data

Dec. 17, 2003 (DE) ..... 103 59 223

(51) Int. Cl.
*H01Q 1/32* (2006.01)

(52) U.S. Cl. ..... 343/713

(58) Field of Classification Search ..... 343/711–713
See application file for complete search history.

(56) References Cited

U.S. PATENT DOCUMENTS

| | | | | |
|---|---|---|---|---|
| 4,954,797 | A | 9/1990 | Shinnai et al. | |
| 5,113,195 | A * | 5/1992 | Sakurai et al. | 343/704 |
| 6,130,645 | A * | 10/2000 | Lindenmeier et al. | 343/704 |
| 6,239,758 | B1 | 5/2001 | Duersch et al. | |
| 6,271,798 | B1 * | 8/2001 | Endo et al. | 343/713 |
| 6,498,588 | B1 | 12/2002 | Callaghan | |
| 7,106,262 | B2 * | 9/2006 | Baranski | 343/713 |
| 2001/0033249 | A1 * | 10/2001 | Endo et al. | 343/713 |
| 2003/0034927 | A1 * | 2/2003 | Deininger | 343/713 |
| 2005/0035913 | A1 * | 2/2005 | Baranski | 343/713 |
| 2007/0152895 | A1 * | 7/2007 | Heuser et al. | 343/713 |

FOREIGN PATENT DOCUMENTS

| | | | |
|---|---|---|---|
| DE | 39 10 031 | | 10/1989 |
| EP | 0 269 723 | | 6/1988 |
| EP | 0 411 963 | | 2/1991 |
| EP | 0 560 677 | | 9/1993 |
| EP | 0 382 895 | | 12/1993 |
| JP | 7-94926 | | 4/1995 |
| JP | 2001-156519 | | 6/2001 |
| JP | 2001156519 | | 6/2001 |
| JP | 2002084119 | * | 3/2002 |
| JP | 2002-118406 | | 4/2002 |
| JP | 2002118406 | | 4/2002 |
| JP | 2003-087027 | | 3/2003 |
| JP | 2006-500130 | | 11/2006 |
| WO | 99 66587 | | 12/1999 |
| WO | WO2005/060044 | | 6/2005 |

* cited by examiner

*Primary Examiner*—Huedung Mancuso
(74) *Attorney, Agent, or Firm*—Kenyon & Kenyon LLP

(57) ABSTRACT

In a window-integrated antenna in vehicles, the heating conductor field (3,4) is used for FM reception as well as for LMS reception. At least one decoupling element (6) is provided for LMS reception which has a high-frequency, but non-galvanic connection to the heating conductor field (3,4). The decoupling element (6) is situated in the heating conductor field, in particular between two adjacent heating conductors (3).

12 Claims, 3 Drawing Sheets

WINDOW-INTEGRATED ANTENNA IN VEHICLES

FIELD OF THE INVENTION

The present invention is directed to a window-integrated antenna in vehicles including a heating field which is provided for both FM reception as well as LMS reception.

BACKGROUND INFORMATION

The heating field of the window is frequently used in vehicle antennas as the antenna structure. The heating field is provided for both FM and TV reception in U.S. Pat. No. 6,498,588 and in PCT Published International Application No. 99/66587. A conductor loop, which is not connected to the heating field, is additionally provided for LMS (long, medium, short wave) reception on the upper edge of the window.

A significant disadvantage of such a system is the necessity of a surface, e.g., in the upper area of the window, which, due to non-existing heating conductors, cannot be heated and therefore cannot be defrosted. The available heatable area is unacceptably small, particularly in passenger cars having small windows.

The heating conductors run essentially horizontally and essentially parallel to the metallic boundaries of the window. Interference in the vehicle electrical system, transferred by the heating current to the heating conductors acting as the antenna, must, as is known, be suppressed via modules having a high-resistance behavior at high frequencies when the antenna connection point is galvanically linked to the heating field. For FM reception, these modules are one core double chokes, for example, which are integrated into the heating current-supplying conductor segments and, as a rule, are situated at the heating current terminals of the heating field.

For LMS reception, this is a current-compensated toroidal core choke (AM blocking circuit) which is also situated in the heating current supply lead. This AM blocking circuit is a very cost-intensive module whose dead weight of approximately 200 g results in high mechanical stresses on the printed circuit board as well as the union points, and is thus to be valued extremely critical with respect to quality assurance. The vibrations, occurring during normal driving conditions, result in the fact that soldered joints are extremely stressed. In compact vehicles, this AM blocking circuit is frequently mounted in the tailgate, so that accelerations of approximately 50 g may occur when the tailgate is slammed shut and the module breaks off the union points.

In other vehicle antenna reception systems, the reception of LMS and diverse FM signals is implemented via conductor structures in one or multiple window panes which are for the most part situated in the immediate proximity of, but spatially separated from, one another. A significant disadvantage in such a system is the necessity of at least two, for the most part fixed, window panes which results in increased expenses for the manufacture of the panes, for the electronic design of connected, for the most part active circuit components, and for the assembly of appropriate circuit carriers.

Antenna systems are also known which form the antennas for LMS and FM reception from the galvanically contacted heating field. Here also, filter elements, which decouple the vehicle electrical system, are necessary for the antenna connection point and the heating conductor (European Published Patent Application No. 0 269 723 and European Published Patent Application No. 0 382 895).

SUMMARY OF THE INVENTION

Using a heating conductor field which is provided for FM reception, and possibly TV reception, as well as for LMS reception via one single window, at least one decoupling element being provided for at least the LMS reception which has a high-frequency, but non-galvanic connection to the heating field and the decoupling element being situated in the heating conductor field, in particular between two adjacent heating conductors, the reception of LMS and in particular diverse FM/TV signals is possible via one single window without omitting complete heating of the entire window, in particular in the area not covered by black print. At the same time, the filter elements necessary for the LMS radio broadcast may be omitted, or the filter elements may be designed at a substantial cost advantage compared to previous systems. A separate analysis of the occurring mechanical stress on this module may be omitted and the quality of the system using cost-effective filter modules may be ensured over the vehicle's service life. The basic noise of the antenna for LMS radio reception may be substantially reduced by retaining filter elements for the LMS range.

The conductor structure is applied to a window via common methods, it being irrelevant in terms of the present invention whether a single-pane safety glass or laminated safety glass is used. The window in question is surrounded by a metallic frame and is, for the most part, designed as the rear window of a motor vehicle. However, the described system may also be used on any other window, e.g., in ships.

The particular advantage of the present invention is the fact that, for decoupling the LMS antenna function from the interference of the vehicle electrical system, either no special filter elements in the form of a current-compensated toroidal core choke (high-frequency, low-resistance module) are necessary, or the basic noise during LMS reception is substantially reduced when filter elements for LMS reception are retained.

In addition to the heating conductors used for defrosting, simply one decoupling element, preferably one additional conductor or an additional conductor loop, is inserted in particular between two parallel running heating conductors, as a rule between the upper two, because the technical performance of the reception system is optimal in this way, in such a way that no galvanic link exists between this conductor and the heating field. Due to the non-galvanic link, interference of the vehicle electrical system has a small influence on the basic noise of the antenna. The capacitive coupling between the heating field and the additional conductor is so minor for LMS frequencies, that interference of the vehicle electrical system in the heating current has practically no or only a negligible influence. However, the capacitive coupling for FM and TV frequencies is sufficiently high so that the antenna signals are received using the entire heating conductor structure. Filter elements are necessary here. Due to the high capacitive coupling, the antenna function is comparable to a system in which the antenna connection point is galvanically linked to the heating field. In addition, the entire window is heatable since no structures outside the heating conductor field are necessary.

Cost-effective manufacture is another advantage of the design according to the present invention. In contrast to other embodiments, only one single window pane needs to be manufactured. Another advantage is the integrated and thus simple configuration of passive and active circuit components which provide separate signal paths for the different frequency bands, but which may be placed in one single housing. In addition to a minimum of mechanical components, this also results in minimal wiring.

DETAILED DESCRIPTION

Figure 1:
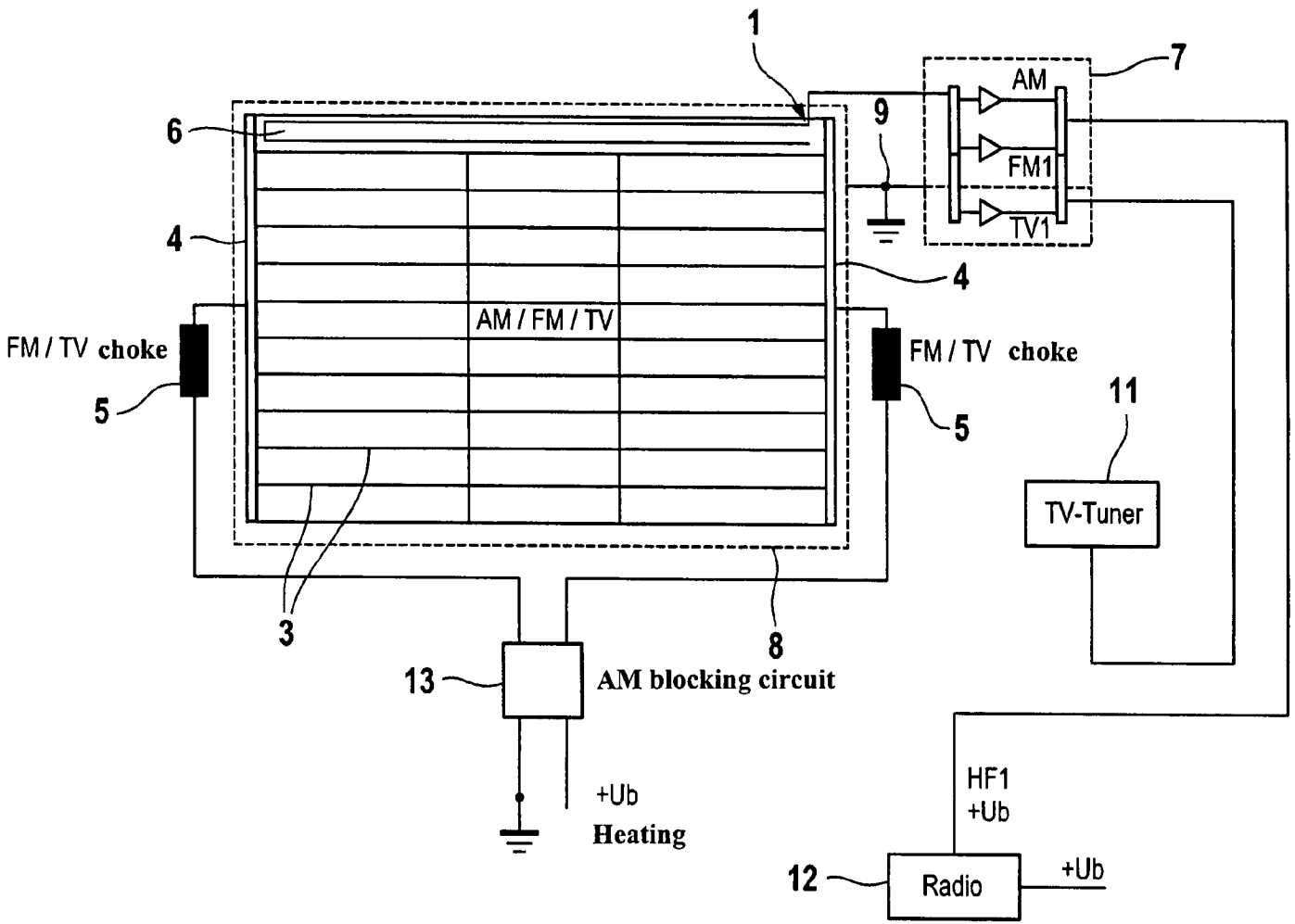
FIG. 1 shows an integrated antenna system for LMS, FM, and possibly TV reception according to the present invention.

FIG. 1 shows a window-integrated antenna made up of heating conductors 3, running parallel to one another, which each meet a busbar 4 at their left and right ends. The heating conductor field formed in this way is supplied with heating current via an FM/TV choke 5 in the supply leads (Ub heating). Depending on the acceptance of the basic noise, an AM blocking circuit 13 having more or less expensive filters is or is not provided. Antenna connection point 1 for FM/TV and LMS signals is galvanically linked with a decoupling element 5 in the heating conductor field but not with the heating conductor field. Decoupling element 6 may be designed as a straight-line conductor, as an open conductor loop as shown in FIG. 1, or as a closed conductor loop, or a combination of the latter elements. A structure as long as possible is advantageous. Decoupling element 6 is situated in particular between two adjacent heating conductors 3 and runs parallel (legs of the open conductor loop) to the entire length of both heating conductors 3. The distance of decoupling element 6 or its conductor segments parallel to heating conductors 3 should be as small as possible, in order to ensure a capacitive coupling for FM/TV frequencies. Grounding point 9 for the connection of active antenna module 7 is advantageously located in the direct proximity of antenna connection point 1 in the right upper corner of the heating conductor field on metallic frame 8 surrounding the window (shown in a dashed line).

The heating conductor structure of the window is designed in such a way that a resonant structure for FM frequencies is created at antenna connection point 1, e.g., via additional vertical crossing lines 10 which are galvanically connected to the parallel heating conductors at each crossing point and are situated on the equi-potential points formed by the voltage distribution.

The decoupled antenna signals are separately amplified (AM, FM, TV1) in electronics module 7 and, if needed, filtered and supplied to TV tuner 11 or radio 12.

Figure 2:
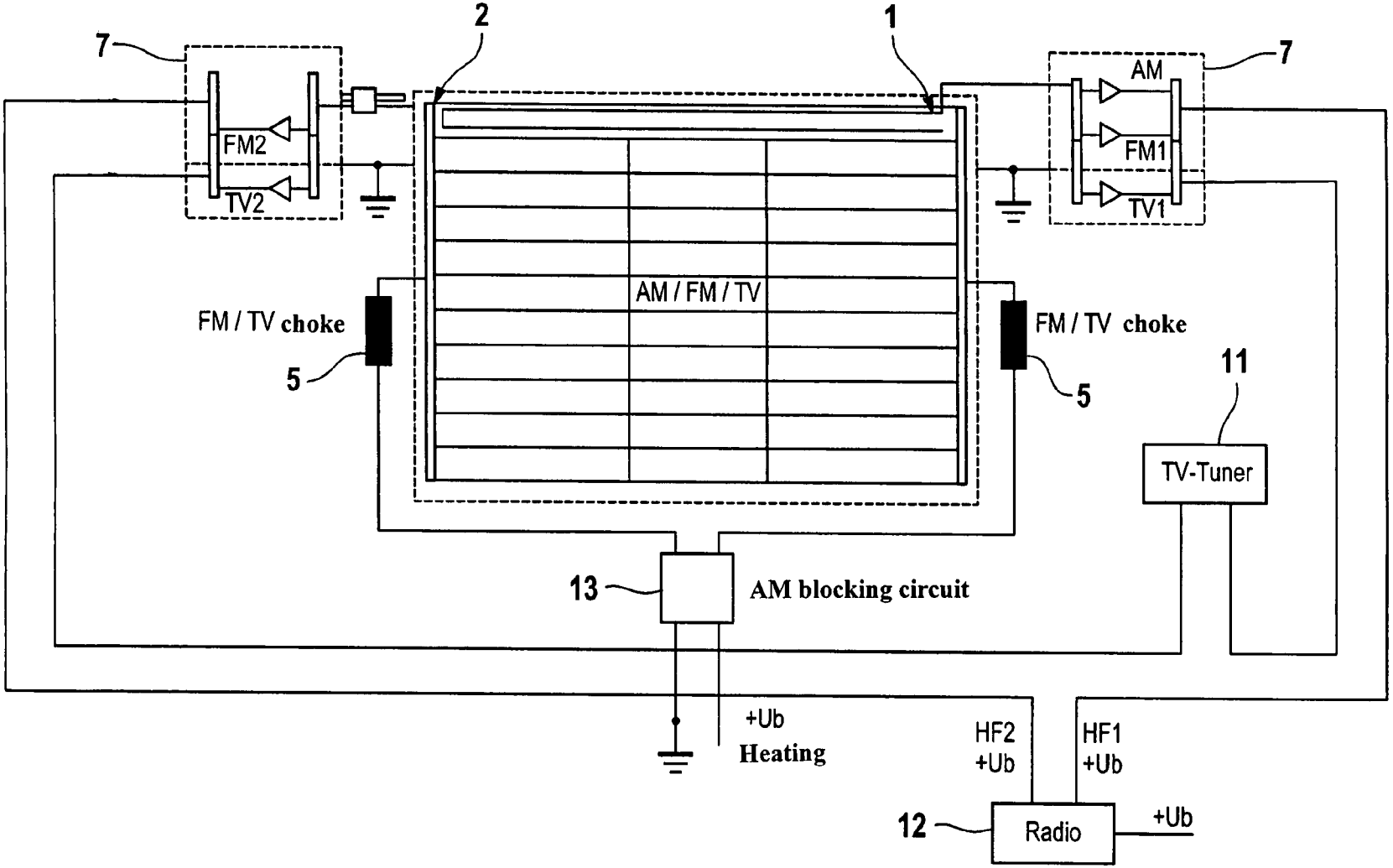
FIG. 2 shows another exemplary embodiment including another FM/TV antenna signal decoupling.
Figure 3:
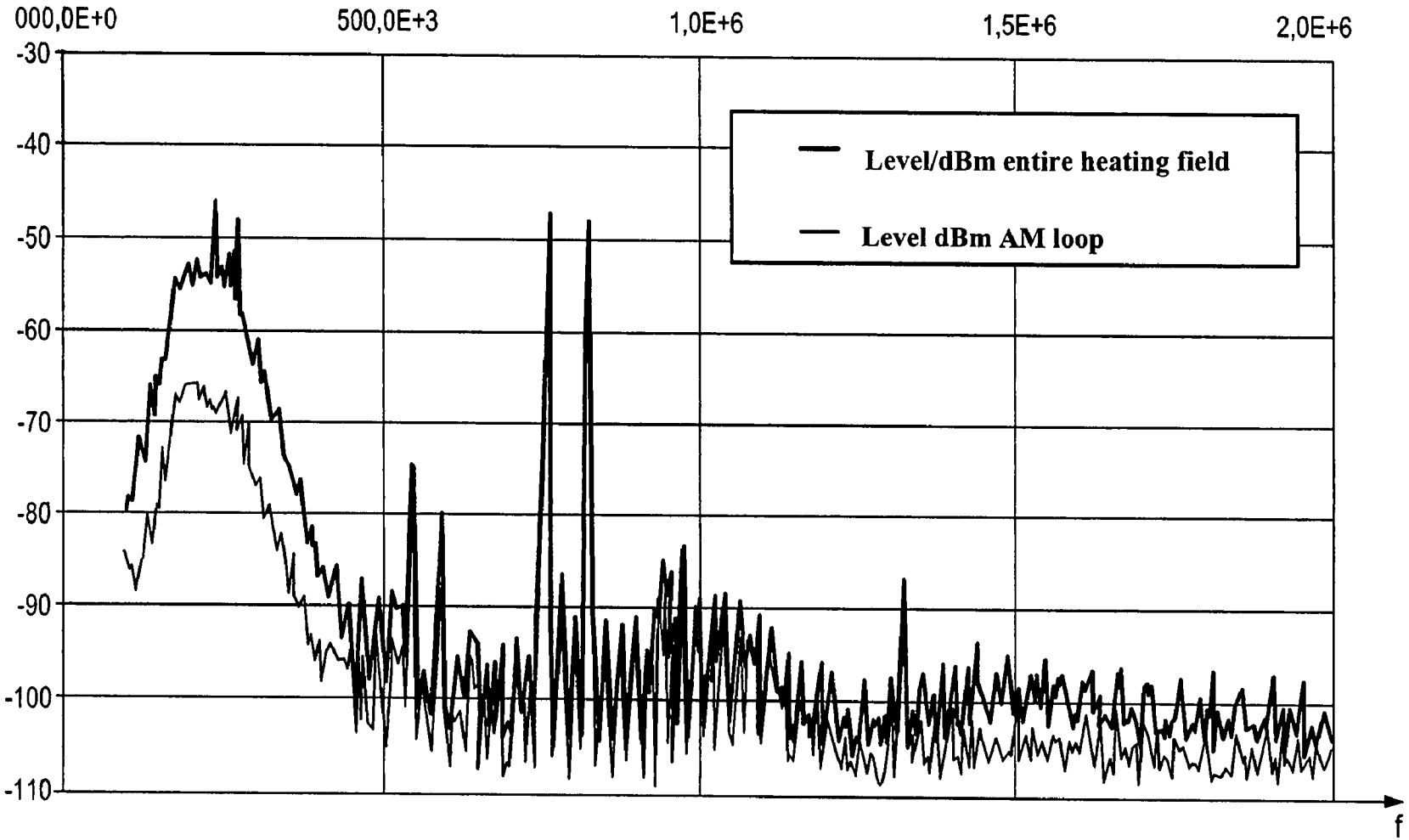
FIG. 3 shows a comparison of the reception level in the LMS frequency range.

FIG. 2 shows another exemplary embodiment in which another FM/TV antenna signal decoupling is formed from antenna connection point 2, galvanically linked to the heating field on the opposite side, and a close-by ground terminal, thereby forming a dual-antenna system. Additional antennas may be formed from the heating field at another location, e.g., two additional antennas to generate a quadruple-antenna system. This makes it possible to scan a further FM or TV range, to operate a second FM receiver, or a diversity effect due to different reception signals at the two antenna connection points 1 and 2 may be utilized, such as the one which may occur under unfavorable reception conditions during mobile use.

A further advantage of the present invention becomes apparent at this point:

The capacitance of the antenna conductor vis-á-vis the chassis ground is a deciding factor in LMS reception. In the system according to the related art, the overall capacitance of the system with regard to antenna connection 1 is increased in a dual-antenna system by connecting a second electronic module having a certain input capacitance. In other words, part of the received LMS signal is diverted toward ground via the second module, thereby impairing the overall reception. This circumstance is prevented in the antenna system according to the present invention.

Measurements show that the reception of LMS signals using the system according to the present invention shown in FIG. 1 is comparable to a system in which the antenna connection point is galvanically linked with the heating field at the upper outer corner. It becomes apparent here that an open conductor loop, as shown in FIG. 1, yields the best results. The reception level is marginally lower, but a lower basic noise is generated by the heating current in exchange.

The reception performance for FM/TV reception is comparable to known systems.

What is claimed is:

1. A window-integrated antenna in a vehicle, comprising:

a heating conductor field provided for at least one of FM reception, TV reception, and LMS reception;

at least one decoupling element for at least the LMS reception, the at least one decoupling element including a high-frequency and non-galvanic connection to the heating conductor field, wherein the at least one decoupling element is situated in the heating conductor field between two adjacent heating conductors;

an FM/TV choke provided in a heating circuit; and antenna conductors situated in the heating conductor field substantially perpendicularly to the heating conductors and galvanically linked to the heating conductors;

wherein the at least one decoupling element is for the FM reception and the TV reception, wherein the antenna conductors are designed, with regard to at least one of a length and a position thereof, so that a resonance-like behavior of the antenna occurs at a connection end of the at least one decoupling element in an FM range, and wherein the at least one decoupling element includes at least one of a straight-line conductor, an open conductor loop, and a closed conductor loop.

2. The window-integrated antenna as recited in claim 1, wherein a grounding point for decoupling at least one of an LMS antenna signal, an FM antenna signal, and a TV antenna signal is located in a proximity of a connection end of the at least one decoupling element.

3. The window-integrated antenna as recited in claim 1, wherein at least one further FM/TV antenna signal decoupling is provided that is galvanically linked to the heating conductor field, and to a busbar situated at a distance from a connection end of the at least one decoupling element.

4. The window-integrated antenna as recited in claim 1, wherein a distance of the at least one decoupling element to one of the heating conductors is selected to be so close that a capacitive coupling with the heating conductor is ensured for FM/TV frequencies.

5. The window-integrated antenna as recited in claim 4, wherein the at least one decoupling element includes one of a straight-line conductor and a conductor loop.

6. The window-integrated antenna as recited in claim 1, wherein:

a grounding point for decoupling at least one of an LMS antenna signal, an FM antenna signal, and a TV antenna signal is located in a proximity of a connection end of the at least one decoupling element, at least one further FM/TV antenna signal decoupling is provided that is galvanically linked to the heating conductor field, and to a busbar situated at a distance from a connection end of the at least one decoupling element, a distance of the at least one decoupling element to one of the heating conductors is selected to be so close that a capacitive coupling with the heating conductor is ensured for FM/TV frequencies, and the at least one decoupling element includes one of a straight-line conductor and a conductor loop.

7. A window-integrated antenna in a vehicle, comprising:

a heating conductor field provided for at least one of FM reception, TV reception, and LMS reception;

at least one decoupling element for at least the LMS reception, the at least one decoupling element including a high-frequency and non-galvanic connection to the heating conductor field, wherein the at least one decoupling element is situated in the heating conductor field between two adjacent heating conductors;

wherein:

a grounding point for decoupling at least one of an LMS antenna signal, an FM antenna signal, and a TV antenna signal is located in a proximity of a connection end of the at least one decoupling element, at least one further FM/TV antenna signal decoupling is provided that is galvanically linked to the heating conductor field, and to a busbar situated at a distance from a connection end of the at least one decoupling element, a distance of the at least one decoupling element to one of the heating conductors is selected to be so close that a capacitive coupling with the heating conductor is ensured for FM/TV frequencies, and the at least one decoupling element includes one of a straight-line conductor and a conductor loop.

8. The window-integrated antenna as recited in claim 7, wherein the at least one decoupling element is for the FM reception and the TV reception.

9. The window-integrated antenna as recited in claim 8, further comprising:

an FM/TV choke provided in a heating circuit.

10. The window-integrated antenna as recited in claim 7, further comprising:

antenna conductors situated in the heating conductor field substantially perpendicularly to the heating conductors and galvanically linked to the heating conductors.

11. The window-integrated antenna as recited in claim 10, wherein the antenna conductors are designed, with regard to at least one of a length and a position thereof, so that a resonance-like behavior of the antenna occurs at a connection end of the at least one decoupling element in an FM range.

12. The window-integrated antenna as recited in claim 7, wherein the at least one decoupling element includes at least one of a straight-line conductor, an open conductor loop, and a closed conductor loop.

* * * * *